US007681511B2

(12) United States Patent
Breivik et al.

(10) Patent No.: US 7,681,511 B2
(45) Date of Patent: Mar. 23, 2010

(54) SYSTEM FOR LOADING AND UNLOADING OF HYDROCARBONS IN ICE PRONE WATERS

(75) Inventors: Kåre Breivik, Tau (NO); Harald Kleppestø, Bryne (NO)

(73) Assignee: Statoilhydro ASA, Stavanger (NO)

( * ) Notice: Subject to any disclaimer, the term of this patent is extended or adjusted under 35 U.S.C. 154(b) by 0 days.

(21) Appl. No.: 12/301,704

(22) PCT Filed: Apr. 18, 2007

(86) PCT No.: PCT/NO2007/000129

§ 371 (c)(1),
(2), (4) Date: Jan. 8, 2009

(87) PCT Pub. No.: WO2007/136273

PCT Pub. Date: Nov. 29, 2007

(65) Prior Publication Data

US 2009/0199755 A1 Aug. 13, 2009

(30) Foreign Application Priority Data

May 22, 2006 (NO) ..... 20062287

(51) Int. Cl.
*B63B 35/08* (2006.01)

(52) U.S. Cl. ..... 114/40

(58) Field of Classification Search ..... 114/40–42; 441/3–5

See application file for complete search history.

(56) References Cited

U.S. PATENT DOCUMENTS

| | | | | |
|---|---|---|---|---|
| 3,768,427 | A * | 10/1973 | Stephens | 114/41 |
| 3,886,882 | A * | 6/1975 | Thornburg et al. | 114/40 |
| 4,273,066 | A | 6/1981 | Anderson | |
| 4,348,059 | A * | 9/1982 | Morgan | 299/25 |
| 4,826,353 | A * | 5/1989 | Statham | 405/61 |
| 5,036,781 | A | 8/1991 | Järvi | |
| 6,216,628 | B1 * | 4/2001 | Poldervaart | 114/293 |
| 7,270,066 | B2 * | 9/2007 | Kulikov et al. | 114/40 |

FOREIGN PATENT DOCUMENTS

| | | |
|---|---|---|
| EP | 1 533 224 | 5/2005 |
| WO | WO-96/17777 | 6/1996 |
| WO | WO-96/36529 | 11/1996 |

* cited by examiner

*Primary Examiner*—Stephen Avila
(74) *Attorney, Agent, or Firm*—Foley & Lardner LLP

(57) ABSTRACT

System for loading and unloading of hydrocarbons in waters with varying conditions, comprising an icebreaking vessel (10) moored to a sea bed (12) by a turret buoy (11) and where a tanker (16) by at least one hawser (17) is moored with its bow to the aft end of the icebreaker either at a distance from the icebreaker (10) in situations without influence from ice, or in physical contact with the icebreaker in situation when ice is present. The system further comprises at least one hose (24) and valve system for transferring hydrocarbons from the icebreaker (10) to the tanker (16).

7 Claims, 5 Drawing Sheets

Figures 1A, 1B:
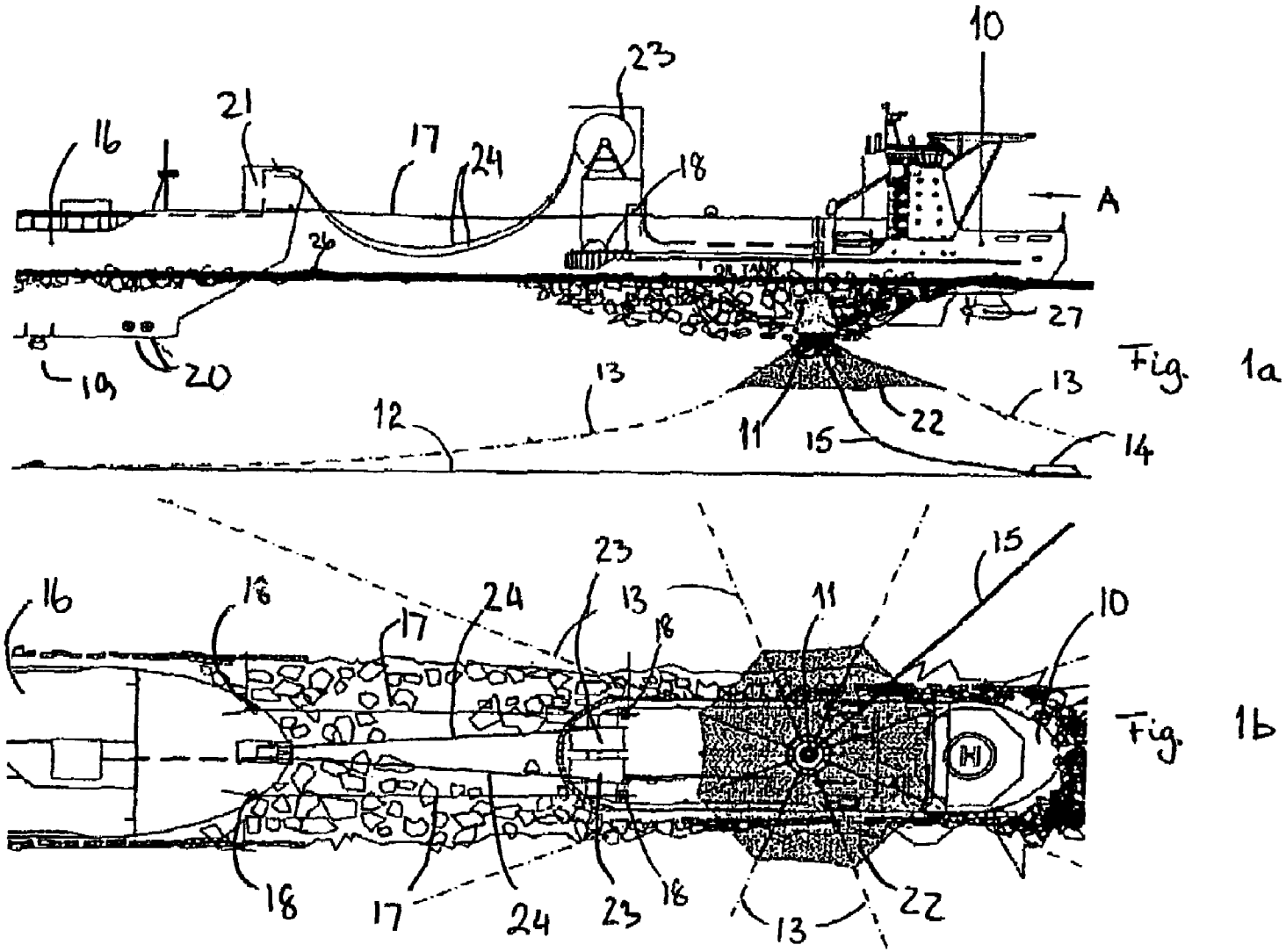

A
10
11
12
13
14
15
16
17
18
19
20
21
22
23
24
26
27

10
A
14
22
11
12
13
18
25'
25
17
24
26
21
16
15
OIL TANK

OIL TANK
A
10
11
12
13
14
15
16
17
18
22
24
25
26
27

Arctic Tandem Offloading Terminal (Concept a)

SYSTEM FOR LOADING AND UNLOADING OF HYDROCARBONS IN ICE PRONE WATERS

THE TECHNICAL FIELD OF THE INVENTION

The present invention relates to a system for loading and unloading of hydrocarbons in waters with changing conditions, varying from periods with extreme ice conditions, such as unbroken ice or packed ice and/or drifting ice which quickly may change direction of flow; to open waters exposed to large waves and very strong wind, wherein a vessel having icebreaking properties is moored to a sea bed, and wherein a vessel by means of at least one hawser is moored with its bow to the aft of the vessel with the icebreaking properties, either at a distance from the vessel with the icebreaking properties during conditions with no influence from the ice or in physical contact with the vessel with the icebreaking properties during conditions where ice is present.

BACKGROUND OF THE INVENTION

Offshore loading of oil and hydrocarbon products, including gas, in ice covered waters has up to present only been performed to a limited extent. The need for this type of operations is expected to increase to a substantial degree in the years to come, amongst other in respect to increased petroleum activities in the arctic waters.

Characteristics for such operation will be that the equipment and systems to a degree must withstand extreme ice and temperature conditions during the winter season. At the same time the equipment must during periods without the presence of ice be able to operate under "open sea" state often characterized by wind and wave conditions, for example corresponding to the ones experienced in the North Sea. Such changing operational conditions between what may be characterized as the boundaries of climatic conditions, imposes particularly strict requirements for the facilities. The ability of quickly adapting to the changing modus from ice operations to "open sea" operations represents great challenges. Correspondingly, the safety aspects are of great importance, and it is imperative and of great importance that the operations may be performed with a very low probability of "no-planned" environmental spillage.

During the winter season temperatures down to −50° C. may be expected together with very challenging ice conditions characterized by, amongst other:

- unbroken surfaces of ice with a thickness between 2-2.5 m.
- packed ice having a total height of typically 25 m (20 m below the sea level and 5 m above the sea level).

During "open sea" operation the facility will typically have to perform loading operations at up to 5.5 m significant wave heights, corresponding to a wave height of up to 10 m. During operation in ice, the impact from the waves will be substantially less.

The real sea regions have in addition often very challenging current conditions which must be catered for when designing and engineering the operations to be performed. It should for example be appreciated that the tidal water generated currents may turn 180 degrees up to four times during a 24 hour period, while at other sites less predictable current conditions may exist.

The real sea areas are often shallow, meaning that the loading installations must be installed relatively far away from shore, so that the water depth may be sufficient. Use of large pipelines may produce high costs.

DESCRIPTION OF THE PRIOR ART

US 2006/0037757 A1, which is filed by the applicant, describes a protective system for protection of risers from drifting ice, where the riser is suspended from a turret buoy, connected to the vessel, and where the upper end of the riser is protected from influence and impact from drifting ice.

US 2005/0235897 A1 and EP 1 533 224 A1 show a system for transfer of hydrocarbons, where an icebreaker and a shuttle tanker, moored to the aft end of the icebreaker is used for transferring hydrocarbons to a tank vessel. The icebreaker is moored to the sea bed by means of four mooring lines and the bow of the tanker is moored to the aft of the icebreaker by means of a hawser, which also forms suspension of the hose for transfer of hydrocarbons from the sea bed to the vessel via the icebreaker. The tanker is moored either at a distance from the icebreaker in case of situations without ice, or in physical contact with the icebreaker in situations with ice appearance.

US 2004/0106339 A1 relates to offshore loading of hydrocarbons where a production vessel is pivotably moored to a submerged buoy and where a shuttle tanker is moored to the aft of the production vessel by means of a hawser.

SUMMARY OF THE INVENTION

An object of the invention is to provide a loading and unloading system with large inherent flexibility and large robustness against the appearing outer environmental forces, such as the possibilities of unintentional oil pollution to the environments are prevented.

Another object of the invention is to provide that loading operations may be performed with high efficiency, even under demanding and changing weather and ice conditions.

A further object is to be able to combine "open sea" and ice operations in an effective and safe manner.

A still further object is to be able to perform loading operations during the course of six hours and where the loading operations in an effective and safe manner may be employed in shallow waters, possibly down to depths about 20 m.

A still further object is to provide a loading system designed for loading rates typically up to 15000-18000 $m^3$ per hour.

Another object is to provide a system which in a safe manner may handle appearances of drifting ice from abaft without creating any safety hazard for the loading or unloading operations.

The objects are achieved by a system for loading and unloading of hydrocarbons which is further defined by the characterizing part of the independent claims.

Preferred embodiments of the invention are defined by the dependent claims.

According to the invention a robust system is provided, enabling loading under extreme conditions, both in open sea state and during situations of strong drifting ice.

Further, the sensitive parts of the loading and unloading system are protected against influence of the appearing ice, so that the possibilities of damaging impact of the sensitive parts of the system are reduced.

Further, the system according to the invention contributes to reductions of the forces in the hawser, since the size of the ice channel produced by the icebreaker is made larger by means of thrusters arranged in the hull of the icebreaker at the fore and/or aft end of the vessel.

The system according to the invention is based on thirty years of experience of North Sea buoy loading operations and is developed for mooring of tank vessels up to 100000 tdw. In offshore operations such sizes are twice as large as the vessels normally employed.

Further advantages of the system according to the invention will be apparent when reading the specifics of the invention, describing such system in respect to the accompanying drawings, disclosing several preferred embodiments of the invention, where:

FIG. 1*a* shows a side view of an icebreaking vessel according to the invention, with a tank vessel moored to the icebreaker at a distance from the former, where the mooring system shown is used for transferring hydrocarbons by means of hoses, stored on drums;

FIG. 1*b* shows a horizontal view of the vessels shown in FIG. 1*a;*

Figures 2A, 2B:
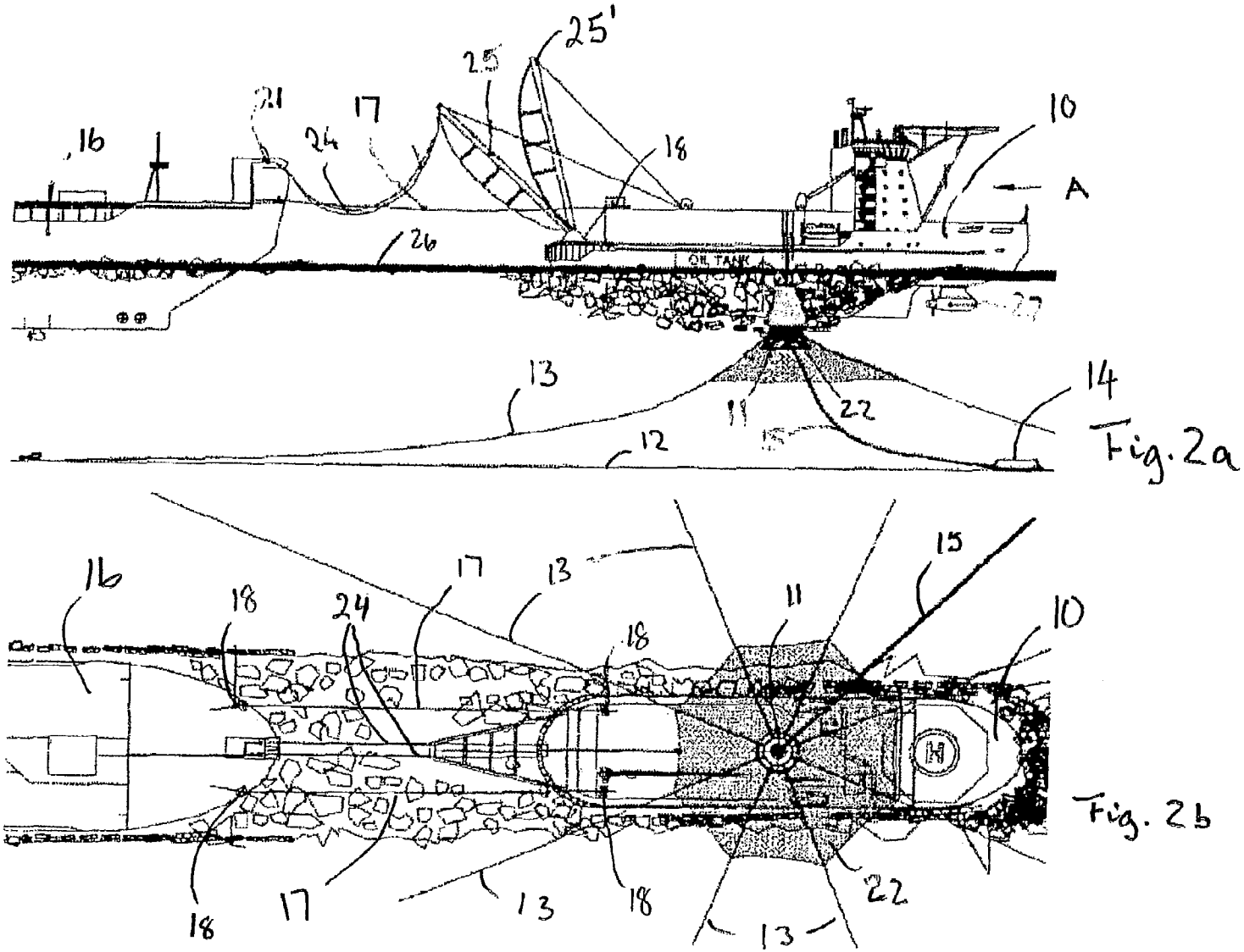
Figures 3A, 3B:
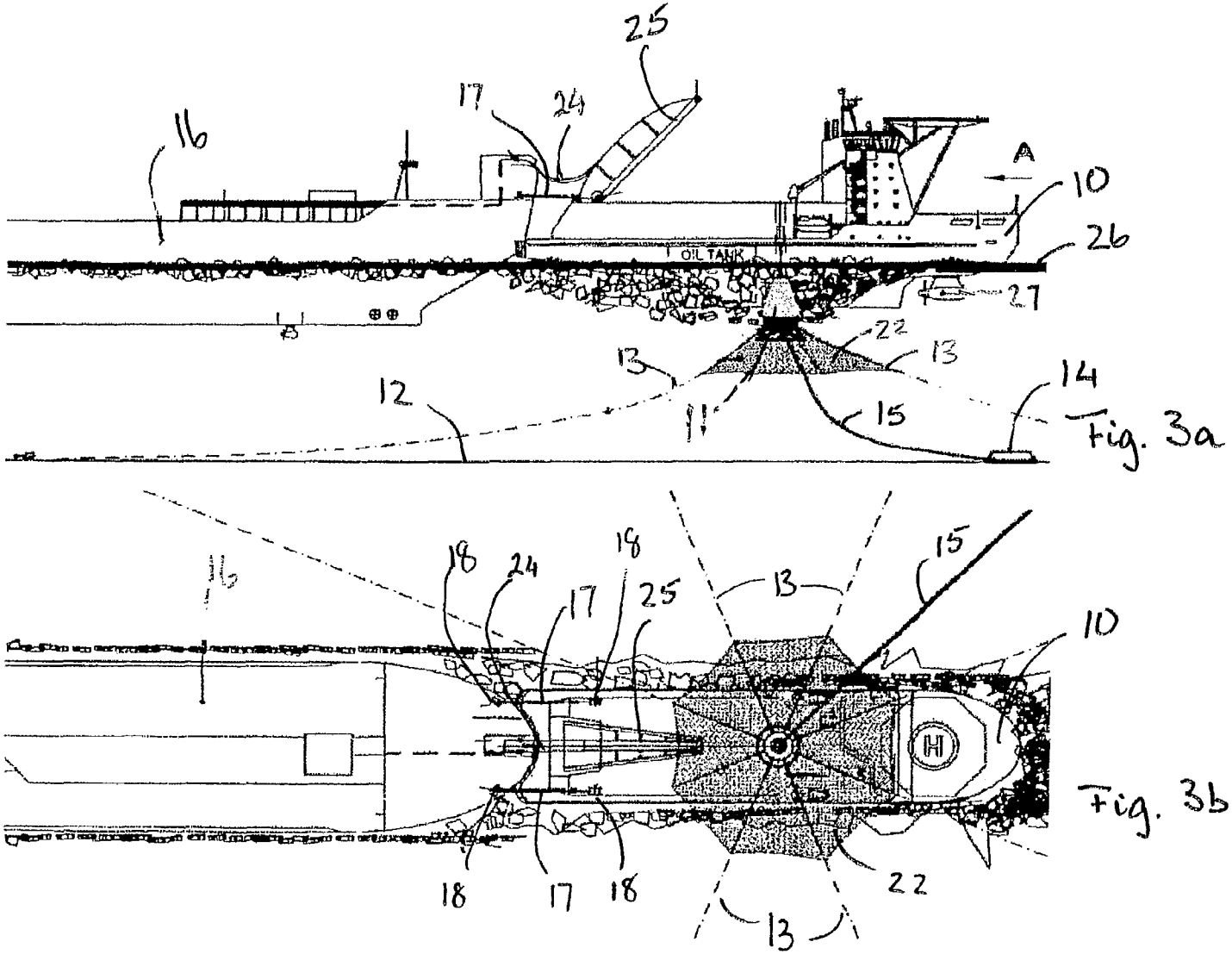
Figure 4:
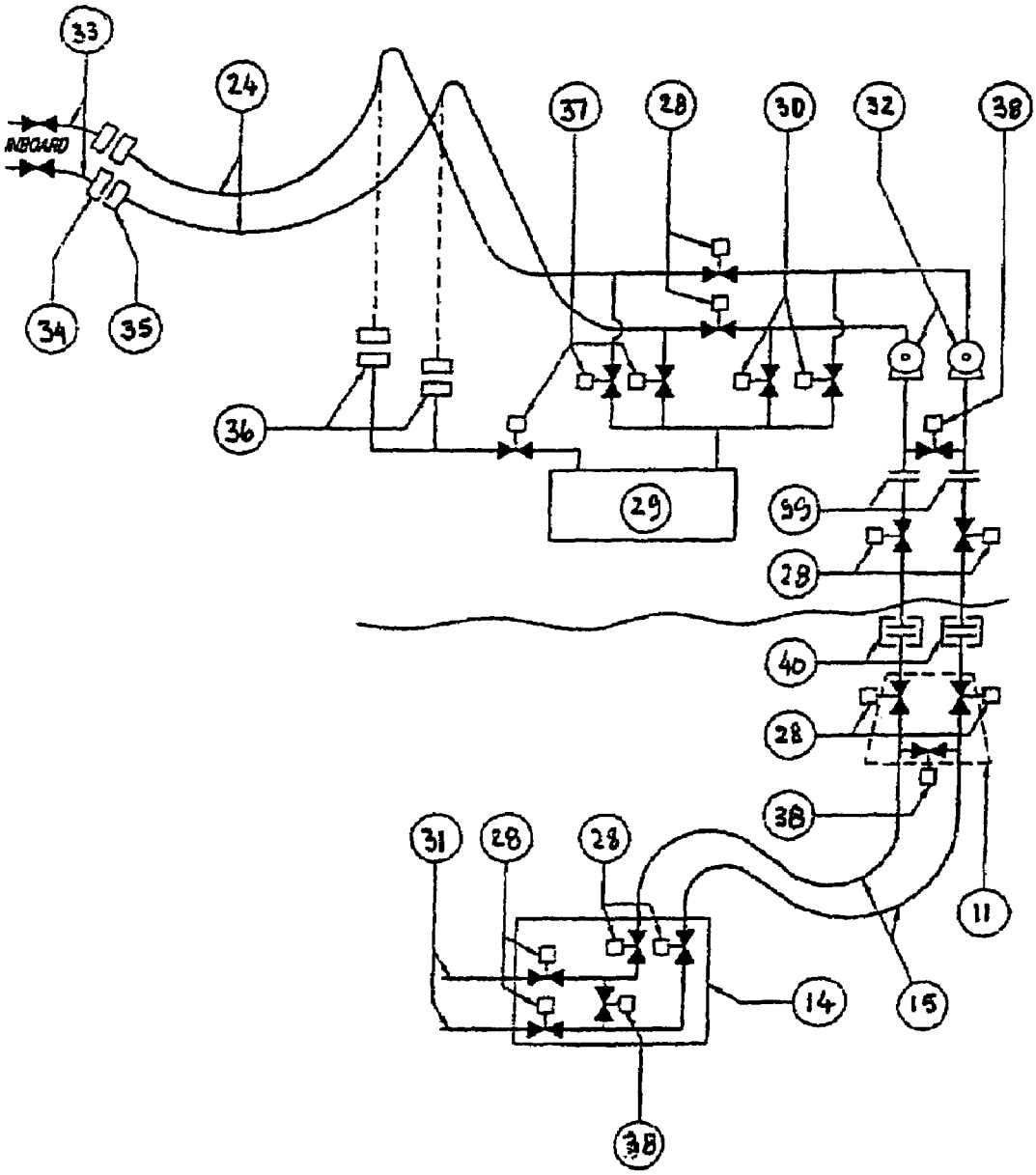
Figure 5A:
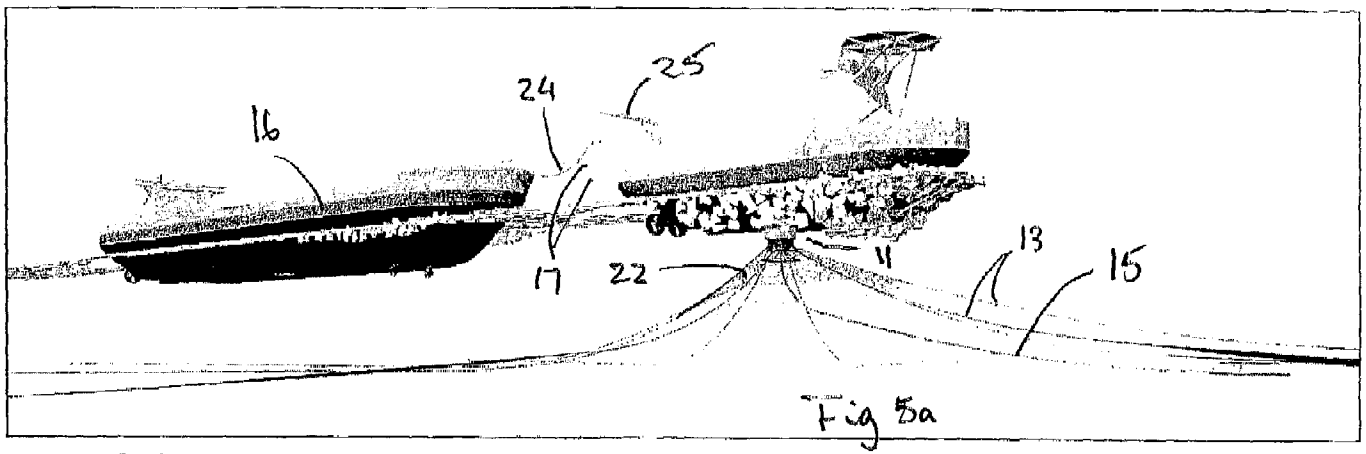
Figure 5C:
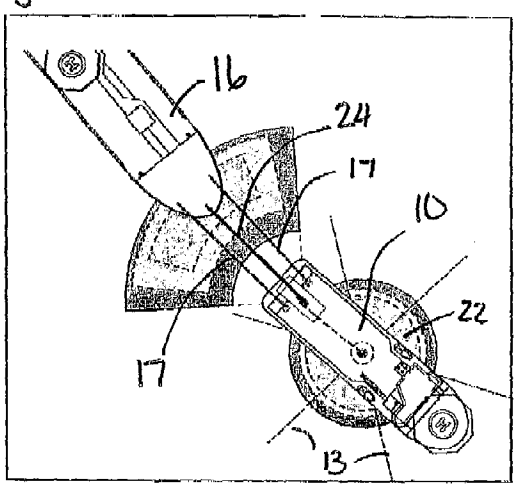
Figure 5B:
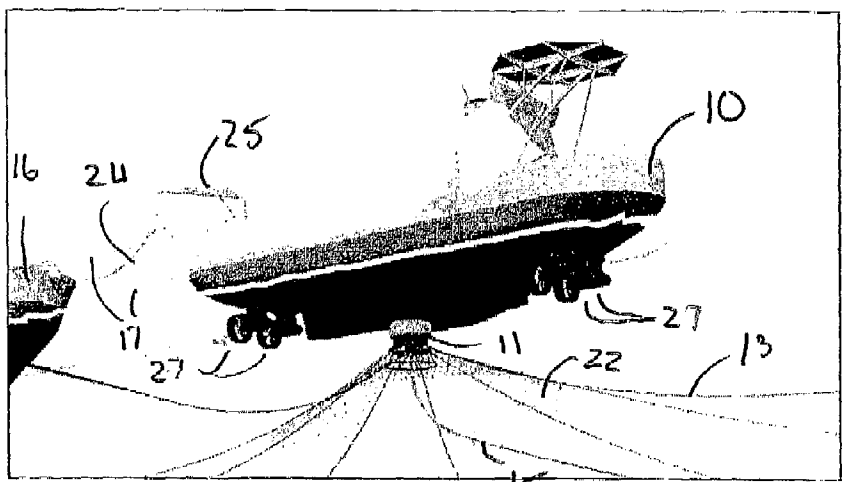

FIGS. 2*a* and 2*b* show corresponding views, where hydrocarbons are transferred by means of hoses suspended from a hose boom;

FIGS. 3*a* and 3*b* shows a view of the two vessels, where the tanker is moored in contact with the icebreaker vessel;

FIG. 4 shows a flow diagram for transfer of hydrocarbons from a sea bed to a tanker via a buoy, through the icebreaker vessel; and FIGS. 5*a*-5*c* show in perspective, different views of the loading and unloading system according to the invention.

Firstly, it should be appreciated that common element shown in the different figures of the drawings will have the same reference numbers. Hence not every detail will be described in relation to each single FIGURE.

FIG. 1*a* shows a side view of an arctic production and tandem offshore terminal, while FIG. 1*b* shows a view seen from above of the unit shown in FIG. 1*a*. The system according to the invention comprises an icebreaking vessel or an Offshore Icebreaker (OIB) 10 which are mid-ship moored to the sea bed by means by means of a turret based mooring system, enabling quick release of the OIB 10 when required or deemed necessary. Connection of the mooring system is achieved without the use of divers.

The mooring system comprises a buoy 11 which at one end is fixed to the sea bed 12 by means of a plurality of mooring lines 13, extending between the buoy 11 and mooring points (not shown) on the sea bed 12. On the sea bed 12, in the vicinity of the icebreaking vessel 10, a template equipped with a so called <<Pipe Line End Manifold>> 14 is installed. A riser 15 extends from the manifold 14 to the icebreaking vessel 10 via the buoy 11. Both the buoy 11, the riser 15 and the connections with the icebreaking vessel are well known in the art and will not be described in further detail.

In order to protect the buoy 11, the riser 15 and the upper parts of the mooring system against impact from ice, a net 22 is installed, preferably attached to the lower end of the buoy 11 and further preferably with its lower end attached to the mooring lines 13, forming a protective surface.

A shuttle tanker 16 is moored to the ice breaker 10 by means of hawsers 17. The tanker 16 is moored at a distance, for example 50-60 m, away from the icebreaker 10. In order to be moored to the icebreaker, the shuttle tanker 16 is approaching the icebreaker 10 from aft. At a distance of about 50-60 m away from the icebreaker 10, the shuttle tanker 16 stops its approach. Hawsers 17 are transferred from the icebreaker 10 to the shuttle tanker 16 by means of a line (not shown), is connected to the mooring winches 18 on the bow part of the shuttle tanker 16. Correspondingly, two such mooring winches are arranged on each side of the aft deck of the icebreaking vessel 10. Two independent hawsers 17 are employed. The hawsers 17 are arranged symmetrical with respect to the centreline of the shuttle tanker 16, so that the bow of the shuttle tanker 16 will be stabilized in direction towards the icebreaker 10 when there is a tension in the hawsers 17. Optionally, two hawsers 17 on each side may be used in order to further securing that the tanker vessel 17 maintains its position even if a hawser 17 should break.

According to the invention an ice reinforced shuttle tanker 16 is employed, which normally also may be equipped with a dynamical positioning system (DP) 19; conventional bow thrusters 20 and offshore loading equipment 21 on the bow region of the tanker 16.

According to an embodiment shown in the FIGS. 1*a* and 1*b*, the loading and unloading system is shown in a period with little ice, so that loading operations may be performed in an "open sea state" mode. For such mode it may be appropriate to perform the loading operation at a distance typically 50-60 m between the two vessels, the reasons being that in relation to offshore loading under "open sea" state, it is common to use the elasticity inherent in the hawsers to compensate for the dynamical loads generated by wave motions. The hawsers 17 are generally made of nylon, providing large elasticity. According to the embodiment shown in FIGS. 1*a* and 1*b*, the icebreaker is further provided with two drums 22 onto which the hoses 24 for transferring hydrocarbons from the icebreaker to the tanker are stored. As shown, the hoses 24 are suspended well above the ice and the sea surface, so that the hoses are unaffected by the ice. Since the hoses 24 are stored on the drums, the active hose length may be adjusted by spooling in or out from the drums 23.

The arrow A in FIG. 1*a* shows the drifting direction of the ice.

FIGS. 2*a* and 2*b* show an alternative embodiment of the invention shown in FIGS. 1*a* and 1*b*, where the main difference with respect to the embodiment shown in FIGS. 1*a* and 1*b* being that a loading boom 25 is used for suspending the two hoses 24 in lieu of the two hose drums 23, the boom 25 being pivotably arranged on the aft deck of the OIB 10. FIG. 2*a* shows the boom 25' in an inactive position, while the reference number 25 is used for the boom position where the boom 25 supports the hoses 24 in the required position, hanging down from the boom 25 well above water and ice surface 26. In such latter modus the boom 25 points upwards and rearwards with respect to the OIB vessel. For this alternative, the hose configuration is adjusted for varying the distances between the two vessels by lifting or lowering the boom 25. The hose boom 25 has a characteristic shape enabling the hoses 24 always to be optimally configured when the boom 25 is rotated towards the OIB.

FIGS. 3*a* and 3*b* show another typical mooring modus, different from the one shown in FIGS. 2*a* and 2*b*; and also different compared to the one shown in FIGS. 1*a* and 1*b*. According to the mooring modus shown in FIGS. 3*a* and 3*b*, the shuttle tanker 16 is moored in close contact with the icebreaking vessel 10. This mooring modus may preferably be used when the ice masses are increasing. In periods with solid ice and drifting packed ice, the most optimal configuration will most probably be to moor the tanker 16 in such way that its bow is in physical contact with the aft end of the icebreaker 0. The icebreaker 10 may preferably provided with a "V"-shaped aft end, protecting with appropriate fender means (not shown). This may in particular be advantageous when the vessels operates in waters where the changes in currents are unpredictable, which in certain circumstances may cause the shuttle tanker 16 to be exposed to ice drifting from abaft so that a risk for impacts caused by collision between the two vessels 10,16 exist. If for example the shuttle tanker is provided with an Azipod or Azimuth propeller system, the disclosed mooring system will actually in periods be able to handle situations with drifting ice from aft without causing a hazard situation. When the shuttle tanker 16 is in physical contact with the "V"-shaped arrangement at the aft end of the OIB 10, the tanker may, in addition to the mooring lines 17 also employ is own propulsion machinery, securing the required position both against the OIB 10 and with respect to the mooring system 11,13 of the OIB 10.

It should be appreciated that in connection with escorting a vessel in ice waters, the icebreakers used are often equipped with equipment having the described "V"-shaped arrangement at the aft end.

Hawser winches 18 on board the OIB 10 are designed with a rendering function, securing that the shuttle tanker 16 will not overstrain the hawsers in periods when the active hawser length is short, i.e. when there is little elasticity available in the mooring system. Such rendering functions will gradually be reduced when the active hawser length and consequently available elasticity is increased. It should be appreciated that such type of winch function with variable rendering function is not previously known or used in connection with offshore loading operations.

When the distance between the vessels 10,16 is adjusted, also the operative hose length must be adjusted.

The OIB 10 may preferably be equipped with one or two thrusters/propellers 27 in the bow region, the main purpose of which being to break up the ice and hence contribute to maintaining the required position of the vessel 10 without overstraining the mooring lines 13.

A main purpose of the two thrusters 27 abaft is to contribute during ice operation, making the ice channel as wide as possible. Ice operation experience shows that the ice channel may be made wider in an effective manner by tilting the thrusters 27 up to 90°. The efficiency may be increased further by using so called nozzle propellers, producing concentrated water jets in required direction. The method is applied on icebreaking vessel, but has not previously be dedicated as a function as described above. The width of the ice channel will be a function of amongst other, the ice thickness, the propeller effect and the thrust angle with respect to the centreline of the vessel 10. For ice thicknesses around 1 m, two thrusters will typically produce an ice channel with a width of 150 m. If the ice thickness is 0.5 m, the width of the ice channel will typically increase to about 300 m. In this connection it should also be appreciated that the width of the ice channel will be larger if the vessel does not move forward, which may be case for this particular concept, since the flow energy will be directed in required direction and will not be affected/reduced by the forward directed velocity component.

A comparison should also in this aspect be made to the alternative wherein the loading operation is performed from a platform resting on the sea bed. For such installations, the width of the ice channel may only correspond to the width of the platform, since no thrust energy is available for increasing the width of the ice channel. In most cases the ice channel will not exceed typically 50-70 m, thus a substantial deterioration of the operative conditions, compared with the proposed thrust propeller based solution.

FIGS. 5*a*-5*c* show in perspective an embodiment of the invention, showing that the icebreaker 10 is provided with four thrusters 27, two of which being placed at the bow of the ice breaker 10, and two at the aft end of the icebreaker 10. The Figures show a modus where the shuttle tanker 16 is moored a distance apart from the icebreaker 10.

In the enclosed drawings the OIB 10 is disclosed with parallel hull sides. It should be appreciated, however, that the OIB 10 may be constructed in such way that the hull width may have its largest width at mid-ship, the hull sides forming an angle which is different from 90° with respect to the water line plane. Hence, the OIB 10 may in principle be characterized as something in between a vessel and a floating platform/buoy. The advantage of a solution as described above is that the ice channel behind the OIB will be wider. In addition, the inclined hull sides will be well suited for breaking up the ice, if the vessel 10 is exposed to compacted ice. Such solutions may however always be considered with respect to the capability of the vessel to operate in open sea state.

According to the invention double hoses are used in the loading operation between the OIB and the tanker. Such arrangement yields a high loading rate and short loading time, which is of great significance in waters where the water current directions frequently are changed. As described above, the tidal water dominated current may turn 180° during a six hour period. With two 20"-hoses it will be feasible to complete the loading operation of a 100.000 tdw tanker in the course of such six-hour period. If the loading operation is not completed prior to directional change or reversal of the current, it will otherwise be necessary to disconnect the tanker 16 and re-moor the vessel when the direction of the current again has been stabilized.

Subsequent to completed loading operation, the hose(s) are emptied by means of nitrogen and the hose(s) are then spooled back on the hose drum 8 on the aft deck of the OIB 10. The same type of operations is performed with the mooring hawser, stored on separate storing drums/winches 23 on the aft part of the OIB 10. Alternatively, a hose boom 25 may be used, swinging in above the aft deck of the OIB 10 subsequent to completed loading operation. The loading hose(s) 24 will then adopt a advantageous storing position onboard the OIB 10 as further illustrated in the accompanying drawings.

Onboard the OIB 10, the hoses 24 and the hawsers 17 may preferably be stored under controlled temperature conditions and maintenance may be performed as and when required.

The hose and pipe system may preferably be used in a manner as schematically shown in FIG. 4. The system is provided with the required control valves 28, making it possible to perform the various operational stages. It may amongst others be simple to configure the system for use of one hose 24 only, if required or necessary.

The OIB 10 is equipped with a drainage tank 29 allowing the hose(s) 24 to be emptied and the pipe system onboard and down to PLEM 14, if required. The capacity of this tank 29 may be increased if required, so that the tank during periods where the shuttle tanker 16 is disconnected from the OIB, may function as a storage tank.

As specified above, the OIB 10 may, in addition to the propellers 27 installed fore and aft, be provided with a turret mooring 13 which is so configured that disconnecting of the OIB 10 may be performed typically in the course of one hour under normal situations and within minutes in case of an emergency situation. Correspondingly, it will be possible to connect the OIB 10 to the mooring system within typically one to two hours, dependent upon the existing ice and weather conditions. When connecting, the OIB 10 is positioned above the buoy centre and a subsea means is employed for establishing contact between the OIB 10 and the submerged buoy 11. It should be appreciated that this type of subsea means is of well known technology which is commercially available in the industry.

The mooring system may be of the type <<Submerged Turret Loading>> (STL) or corresponding technology available in industry.

When the OIB 10 operates in iced waters and is connected to the mooring system, ice and ice blocks crushed by the propellers may cause damage to the risers 12 and may also build up between the mooring lines directly below the buoy 13. In order to prevent/reduce such type of accumulation with consequential damages and disturbances in the operations, a protective net 15 or corresponding means is arranged just below the buoy 13 and around the mooring lines 14. The net may typically be made of a flexible material able to resist the motions and the ice impacts which the net is exposed to.

When the OIB is disconnected from the mooring system, it will be naturally to let the buoy rest on the sea bed in shallow waters. Optionally, it may be necessary to excavate a ditch in the sea bed, into which the buoy wholly or partially may be lowered. Hence, it may feasible to operate in waters with a depth typically about 20 m.

The loading system may, however, also in a flexible manner be designed for use at different depths, varying from typically 20 m up to several hundred meters.

Between the OIB 10 and the PLM 14, it may preferably be arranged two flexible risers 15 which are further connected to the pipe system 15, including the required stop valves 28. This arrangement renders it possible to circulate the oil between the OIB 10 and the PLEM 14 when the shuttle tanker is disconnected. Hence, the oil will be prevented from becoming thicker due to low temperature.

The given arrangement will also allow the risers 15 to be emptied of oil for example by forcing the oil to the drainage tank 29 by use of nitrogen. Drainage of the risers 15 will for example be actual when the OIB 10 is to be disconnected in order to avoid pollution and/or undesired drop in temperature in the oil. It may also be possible to prevent the oil inside the risers 15 from solidifying by injecting an appropriate additive liquid.

From the PLEM 14 to shore double pipelines 31 may be arranged, enabling circulation of oil during periods with no loading activities.

So called pressure relieving valves or <<surge>> valves 30 may also be installed on the OIB. If the pressure in the pipe system will increase rapidly, for example as a consequence of operational fault, the pressure relief valves 30 will quickly open and drain oil to the drainage tank 29. Unacceptable pressure chocks in the pipe system are thus avoided. Further, dependent upon requirements, it may be actual to install one or more booster pumps 32 onboard the OIB 10 in order to maintain the high loading rate, even with long pipe lines 31 causing large pressure drops.

A manifold (not shown) may preferably be placed on the fore deck of the shuttle tanker 16, where a bow loading coupling 34 attached for each hose 24. The hoses 24 are for this purpose provided with, in corresponding manner, a hose valve 35. Correspondingly, the opposite ends of the hoses 24 are provided with couplings 36 for the hose valves. Drainage valves 37, by-passes 38, pivot connections 39 and QD/DC 40 are also forming a part of the system.

The OIB 10 may in a simple manner, as described above, be connected to and disconnected from the mooring system. In addition, the OIB may be equipped and manned for several other functions at the oil field. Such functions may be ice-breaking, ice management, stand-by services, oil recovery and fire fighting, inspection and maintenance, field related transport, etc.

At many oil fields, it may probably be of commercial interests to consider such multi-purpose operations.

Finally, it should be appreciated that the described offshore concept also may be combined and/or prepared for vessels performing offshore production of oil and gas. It has recently been filed a patent application by the applicant, with the title "Means for positioning vessels in ice prone waters". The positioning strategy described in the referenced application will also be possible for an OIB 10, ref. amongst other use of ice screws for breaking up the consolidated ice zone.

The invention claimed is:

1. System for loading and unloading of hydrocarbons in waters with varying conditions, changing from demanding ice conditions, such as unbroken ice or packed ice and/or drifting ice which may change direction quickly, to open sea state where the vessel is exposed to large waves and very strong wind, an icebreaking vessel moored to a sea bed and where a tanker by means of at least one hawser is moored with its bow to the aft end of the icebreaker either at a distance from the icebreaker in situations without influence from the ice, or in physical contact with the icebreaker in situation when ice is present, charaterized in that the icebreaker is moored to the sea bed by means of a turret buoy, the turret buoy comprising a riser for conveying hydrocarbons to the icebreaker, a submergible floating body and a mooring system, mooring the turret buoy to the sea bed by means of several anchor lines, the ice-breaker being configured in such way that it is allowed to rotate with respect to the turret buoy, dependent upon the direction of waves, tidal streams, ice and wind, that said at least one hawser extend between a winch on the deck of one of the vessels to the other vessel in order to moor the tanker to the icebreaker, means in the form of at least one hose and valve system for transferring hydrocarbons from the icebreaker to the tanker, said at least one hose being configured to hang freely above the sea and ice level, the at least one hose being either suspended from a drum on the aft deck of the icebreaker, or suspended from a boom arranged on the aft deck of the icebreaker, means for preventing ice from coming into contact with the turret and/or the riser, and with releasable hose connections between the turret to the ice breaker and between the icebreaker and the tanker, so that loading operations of hydrocarbons quickly may be aborted, avoiding the possibilities of oil pollutions.

2. System according to claim 1, wherein the means for preventing ice from coming into contact with the riser, comprises a net which at one side is attached to the lower part of the turret and at the other side is attached to one or more anchor lines, so that an umbrella shaped protection means is provided, surrounding the riser.

3. System according to claim 1, wherein the means for preventing ice from coming into contact with the riser comprises at least one thruster arranged on the icebreaker.

4. System according to claim 3, wherein the thruster(s) is arranged at the bow part of the icebreaker, the thruster(s) being configured to create a water stream transporting the ice away from vicinity of the riser.

5. System according to claim 3, wherein thruster(s) are arranged at the aft end of the icebreaker in order to produce as large ice channel as possible.

6. System according to claim 1, wherein the winch is of an active type having a rendering function, securing that the tanker does not overload the hawser(s) in periods where the active hawser length are short.

7. System according to claim 1, wherein the icebreaker may serve several functions at the offshore field, such as stand-by services, oil recovery and fire fighting, inspection and maintenance, and field related transport.

* * * * *

US007681511C1

(12) EX PARTE REEXAMINATION CERTIFICATE (45th)

Ex Parte Reexamination Ordered under 35 U.S.C. 257

United States Patent

Breivik et al.

(10) Number: US 7,681,511 C1

(45) Certificate Issued: Dec. 10, 2015

(54) SYSTEM FOR LOADING AND UNLOADING OF HYDROCARBONS IN ICE PRONE WATERS

(75) Inventors: Kåre Breivik, Tau (NO); Harald Kleppestø, Bryne (NO)

(73) Assignee: STATOIL PETROLEUM AS, Stavanger (NO)

Supplemental Examination Request:
No. 96/000,102, Apr. 9, 2015

Reexamination Certificate for:

| | |
|---|---|
| Patent No.: | **7,681,511** |
| Issued: | **Mar. 23, 2010** |
| Appl. No.: | **12/301,704** |
| PCT Filed: | **Apr. 18, 2007** |
| PCT No.: | **PCT/NO2007/000129** |
| § 371 (c)(1), (2), (4) Date: | **Jan. 8, 2009** |
| PCT Pub. No.: | **WO2007/136273** |
| PCT Pub. Date: | **Nov. 29, 2007** |

(30) Foreign Application Priority Data

May 22, 2006 (NO) ..... 20062287

(51) Int. Cl.
*B63B 35/08* (2006.01)

(52) U.S. Cl.
CPC ..... *B63B 35/08* (2013.01); *B63B 2211/06* (2013.01)

(58) Field of Classification Search
CPC ..... B63B 27/24; B63B 22/021
USPC ..... 114/40
See application file for complete search history.

(56) References Cited

To view the complete listing of prior art documents cited during the supplemental examination proceeding and the resulting reexamination proceeding for Control Number 96/000,102, please refer to the USPTO's public Patent Application Information Retrieval (PAIR) system under the Display References tab.

*Primary Examiner* — Russell Stormer

(57) ABSTRACT

System for loading and unloading of hydrocarbons in waters with varying conditions, comprising an icebreaking vessel (10) moored to a sea bed (12) by a turret buoy (11) and where a tanker (16) by at least one hawser (17) is moored with its bow to the aft end of the icebreaker either at a distance from the icebreaker (10) in situations without influence from ice, or in physical contact with the icebreaker in situation when ice is present. The system further comprises at least one hose (24) and valve system for transferring hydrocarbons from the icebreaker (10) to the tanker (16).

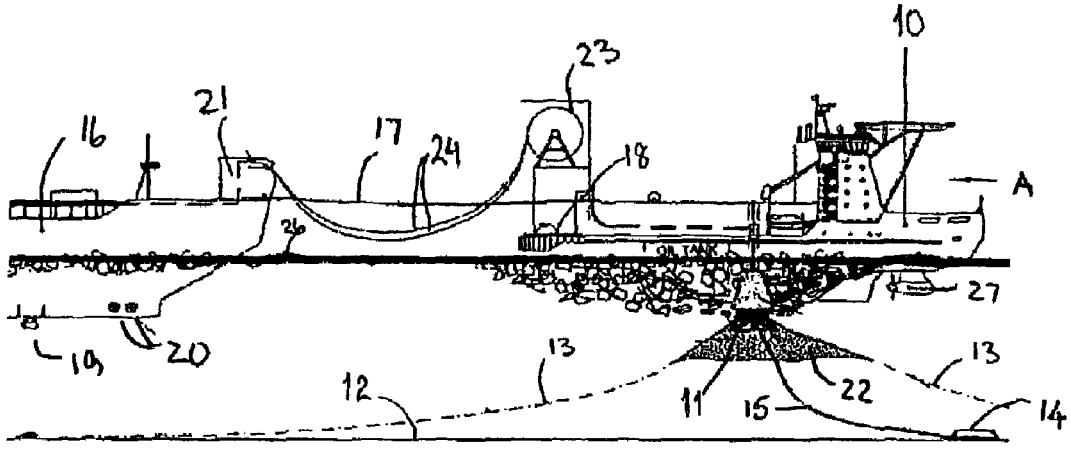

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 39-48:

The mooring system comprises a buoy 11 which at one end is fixed to the sea bed 12 by means of a plurality of mooring lines 13, extending between the buoy 11 and mooring points (not shown) on the sea bed 12. On the sea bed 12, in the vicinity of the icebreaking vessel 10, a template equipped with a so called [<<Pipe Line End Manifold>>] *"Pipe Line End Manifold (PLEM)"* is installed. A riser 15 extends from the manifold 14 to the icebreaking vessel 10 via the buoy 11. Both the buoy 11, the riser 15 and the connections with the icebreaking vessel are well known in the art and will not be described in further detail.

Column 3, line 54 to Column 4, line 5:

A shuttle tanker 16 is moored to the [ice breaker] *icebreaker* 10 by means of hawsers 17. The tanker 16 is moored at a distance, for example 50-60 m, away from the icebreaker 10. In order to be moored to the icebreaker, the shuttle tanker 16 is approaching the icebreaker 10 from aft. At a distance of about 50-60 m away from the icebreaker 10, the shuttle tanker 16 stops its approach. Hawsers 17 are transferred from the icebreaker 10 to the shuttle tanker 16 by means of a line (not shown), is connected to the mooring winches 18 on the bow part of the shuttle tanker 16. Correspondingly, two such mooring winches are arranged on each side of the aft deck of the icebreaking vessel 10. Two independent hawsers 17 are employed. The hawsers 17 are arranged symmetrical with respect to the centreline of the shuttle tanker 16, so that the bow of the shuttle tanker 16 will be stabilized in direction towards the icebreaker 10 when there is a tension in the hawsers 17. Optionally, two hawsers 17 on each side may be used in order to further securing that the *shuttle* tanker [vessel 17] *16* maintains its position even if a hawser 17 should break.

Column 4, lines 11-30:

According to an embodiment shown in the FIGS. 1a and 1b, the loading and unloading system is shown in a period with little ice, so that loading operations may be performed in an "open sea state" mode. For such mode it may be appropriate to perform the loading operation at a distance typically 50-60 m between the two vessels, the reasons being that in relation to offshore loading under "open sea" state, it is common to use the elasticity inherent in the hawsers to compensate for the dynamical loads generated by wave motions. The hawsers 17 are generally made of nylon, providing large elasticity. According to the embodiment shown in FIGS. 1a and 1b, the icebreaker is further provided with two drums [22] *23* onto which the hoses 24 for transferring hydrocarbons from the icebreaker to the tanker are stored. As shown, the hoses 24 are suspended well above the ice and the sea surface, so that the hoses are unaffected by the ice. Since the hoses 24 are stored on the drums, the active hose length may be adjusted by spooling in or out from the drums 23.

Column 4, line 48 to Column 5, line 7:

FIGS. 3a and 3b show another typical mooring modus, different from the one shown in FIGS. 2a and 2b; and also different compared to the one shown in FIGS. 1a and 1b. According to the mooring modus shown in FIGS. 3a and 3b, the shuttle tanker 16 is moored in close contact with the icebreaking vessel 10. This mooring modus may preferably be used when the ice masses are increasing. In periods with solid ice and drifting packed ice, the most optimal configuration will most probably be to moor the tanker 16 in such way that its bow is in physical contact with the aft end of the icebreaker [0] *10*. The icebreaker 10 may preferably *be* provided with a "V"-shaped aft end, protecting with appropriate fender means (not shown). This may in particular be advantageous when the vessels operates in waters where the changes in currents are unpredictable, which in certain circumstances may cause the shuttle tanker 16 to be exposed to ice drifting from abaft so that a risk for impacts caused by collision between the two vessels 10, 16 exist. If for example the shuttle tanker is provided with an Azipod or Azimuth propeller system, the disclosed mooring system will actually in periods be able to handle situations with drifting ice from aft without causing a hazard situation. When the shuttle tanker 16 is in physical contact with the "V"-shaped arrangement at the aft end of the OIB 10, the tanker may, in addition to the mooring lines [17] *13* also employ is own propulsion machinery, securing the required position both against the OIB 10 and with respect to the mooring system 11,13 of the OIB 10.

Column 6, lines 23-32:

Subsequent to completed loading operation, the hose(s) are emptied by means of nitrogen and the hose(s) are then spooled back on the hose drum [8] *23* on the aft deck of the OIB 10. The same type of operations is performed with the mooring hawser, stored on separate storing drums/winches [23] *18* on the aft part of the OIB 10. Alternatively, a hose boom 25 may be used, swinging in above the aft deck of the OIB 10 subsequent to completed loading operation. The loading hose(s) 24 will then adopt [a] *an* advantageous storing position onboard the OIB 10 as further illustrated in the accompanying drawings.

Column 6, lines 48-61:

As specified above, the OIB 10 may, in addition to the propellers 27 installed fore and aft, be provided with a turret mooring [13] which is so configured that disconnecting of the OIB 10 may be performed typically in the course of one hour under normal situations and within minutes in case of an emergency situation. Correspondingly, it will be possible to connect the OIB 10 to the mooring system within typically one to two hours, dependent upon the existing ice and weather conditions. When connecting, the OIB 10 is positioned above the buoy centre and a subsea means is employed for establishing contact between the OIB 10 and the submerged buoy 11. It should be appreciated that this type of subsea means is of well known technology which is commercially available in the industry.

Column 6, lines 62-64:

The mooring system may be of the type [<<Submerged Turret Loading>>] *"Submerged Turret Loading (STL)"* or corresponding technology available in industry.

Column 6, line 65 to Column 7, line 7:

When the OIB 10 operates in iced waters and is connected to the mooring system, ice and ice blocks crushed by the propellers may cause damage to the risers [12] *15* and may also build up between the mooring lines directly below the buoy [13] *11*. In order to prevent/reduce such type of accumulation with consequential damages and disturbances in the operations, a protective net [15] *22* or corresponding means is arranged just below the buoy [13] *11* and around the mooring lines [14] *13*. The net may typically be made of a flexible material able to resist the motions and the ice impacts which the net is exposed to.

Column 7, lines 17-23:

Between the OIB 10 and the [PLM] *PLEM* 14, it may preferably be arranged two flexible risers 15 which are further connected to the pipe system [15], including the required stop valves 28. This arrangement renders it possible to circulate the oil between the OIB 10 and the PLEM 14 when the shuttle tanker is disconnected. Hence, the oil will be prevented from becoming thicker due to low temperature.

Column 7, lines 35-44:

So called pressure relieving valves or [<<surge>>] *"surge"* valves 30 may also be installed on the OIB. If the pressure in the pipe system will increase rapidly, for example as a consequence of operational fault, the pressure relief valves 30 will quickly open and drain oil to the drainage tank 29. Unacceptable pressure chocks in the pipe system are thus avoided. Further, dependent upon requirements, [it may be actual to install] one or more booster pumps 32 *may be installed* onboard the OIB 10 in order to maintain the high loading rate, even with long [pipe lines] *pipelines* 31 causing large pressure drops.

AS A RESULT OF REEXAMINATION, IT HAS BEEN DETERMINED THAT:

Claim 2 is cancelled.

Claims 1, 3, 4, 5, 6 and 7 are determined to be patentable as amended.

1. System for loading and unloading of hydrocarbons in waters with varying conditions, changing from demanding ice conditions, [such as] *where* unbroken ice or packed ice and/or drifting ice which may change direction quickly, to open sea state [where the vessel is exposed to] *with* large waves and very strong wind, an [icebreaking vessel] *icebreaker* moored to a sea bed and where a tanker by means of at least one hawser is moored with its bow to the aft end of the icebreaker either at a distance from the icebreaker in situations without influence from the ice, or in physical contact with the icebreaker in situation when ice is present, [charaterized] *characterized* in that*:* the icebreaker is moored to the sea bed by means of a turret buoy, [the turret buoy comprising] a riser for conveying hydrocarbons to the icebreaker, a submergible floating body, and [a mooring system, mooring the turret buoy to the sea bed by means of several] *one or more* anchor lines *mooring the turret buoy to the sea bed*, the icebreaker being configured in such way that it is allowed to rotate with respect to the turret buoy, dependent upon the direction of waves, tidal streams, ice and wind, that said at least one hawser [extend] *extends* between a winch on the deck of one of the vessels to the other vessel in order to moor the tanker to the icebreaker,

[means in the form of] at least one hose and valve system for transferring hydrocarbons from the icebreaker to the tanker, said at least one hose being configured to hang freely above the sea and ice level, the at least one hose being either suspended from a drum on the aft deck of the icebreaker, or suspended from a boom arranged on the aft deck of the icebreaker,

[means for preventing ice from coming into contact with the turret and/or the riser, and with]

releasable hose connections between the turret *buoy* to the icebreaker and between the icebreaker and the tanker, so that loading operations of hydrocarbons [quickly] may be aborted[, avoiding the possibilities of oil pollutions], *and*

*a net attached to the turret buoy and to the one or more anchor lines, so that an umbrella shape is provided, surrounding the riser*.

3. System according to claim 1, [wherein the means for preventing ice from coming into contact with the riser comprises] *further comprising* at least one thruster arranged on the icebreaker.

4. System according to claim 3, wherein the thruster(s) is arranged at the bow part of the icebreaker, the thruster(s) being configured to create a water stream [transporting the ice away from the vicinity of the riser].

5. System according to claim 3, wherein thruster(s) are arranged at the aft end of the icebreaker in order to produce [as large] *an* ice channel[as possible].

6. System according to claim 1, wherein the winch [is of an active type having] *has* a rendering function, [securing] *ensuring* that the tanker does not overload the hawser(s)[in periods where the active hawser length are short].

7. System according to claim 1, wherein the icebreaker [may serve several functions at the offshore field, such as] *provides* stand-by services, oil recovery and fire fighting, inspection and maintenance, and field related transport.

* * * * *